US008894146B2

(12) United States Patent
Denike

(10) Patent No.: US 8,894,146 B2
(45) Date of Patent: Nov. 25, 2014

(54) PORTABLE SELF-SUPPORTING FIRE FIGHTING EQUIPMENT STATION

(76) Inventor: Richard L. Denike, Ashburn (CA)

( * ) Notice: Subject to any disclaimer, the term of this patent is extended or adjusted under 35 U.S.C. 154(b) by 964 days.

(21) Appl. No.: 13/008,953

(22) Filed: Jan. 19, 2011

(65) Prior Publication Data

US 2011/0114577 A1 May 19, 2011

Related U.S. Application Data

(63) Continuation-in-part of application No. 11/386,825, filed on Mar. 23, 2006, now abandoned.

(51) Int. Cl.
*A47C 15/00* (2006.01)
*A62B 25/00* (2006.01)

(52) U.S. Cl.
CPC ..... *A62B 25/00* (2013.01)
USPC ..... 297/232; 297/257

(58) Field of Classification Search
USPC ..... 297/16.2, 232, 257; 128/845; 211/71.01, 85, 85.24, 85.7, 85.8, 195, 211/196, 203, 205; 248/168
See application file for complete search history.

(56) References Cited

U.S. PATENT DOCUMENTS

| | | | | | |
|---|---|---|---|---|---|
| 315,680 | A * | 4/1885 | Vandenburgh | 248/435 |
| 584,057 | A * | 6/1897 | Lemon | 108/92 |
| 1,459,104 | A * | 6/1923 | Johnson | 362/413 |
| 1,858,254 | A * | 5/1932 | Uline | 297/36 |
| 3,094,802 | A * | 6/1963 | Perry | 40/610 |
| 3,181,542 | A * | 5/1965 | Bareis | 135/98 |
| 3,480,250 | A * | 11/1969 | Hankins | 248/168 |
| 4,203,242 | A * | 5/1980 | Griffin | 40/610 |
| 5,332,283 | A * | 7/1994 | Gray | 297/58 |
| 5,340,193 | A * | 8/1994 | Wolf | 297/232 |
| 5,515,866 | A * | 5/1996 | Somers | 128/845 |
| 5,752,611 | A * | 5/1998 | Nakagawa | 211/186 |
| 5,954,391 | A * | 9/1999 | Gray | 297/58 |
| 6,231,119 | B1 * | 5/2001 | Zheng | 297/16.2 |
| 6,899,388 | B1 * | 5/2005 | Enrique | 297/184.16 |
| 6,910,593 | B1 * | 6/2005 | Moore | 211/85.3 |
| 7,182,303 | B2 * | 2/2007 | Speggiorin | 248/168 |
| 7,422,016 | B2 * | 9/2008 | Klemm | 128/845 |
| 7,552,966 | B2 * | 6/2009 | Crowell | 297/51 |
| 7,604,289 | B2 * | 10/2009 | Chen | 297/159.1 |
| 2002/0005390 | A1 * | 1/2002 | DeRocher et al. | 211/85.7 |
| 2006/0048785 | A1 * | 3/2006 | Dalen et al. | 128/845 |
| 2006/0054576 | A1 * | 3/2006 | Durham | 211/85.7 |
| 2006/0071513 | A1 * | 4/2006 | Pedemonte | 297/16.1 |

OTHER PUBLICATIONS

Notice of References from Parent U.S. Appl. No. 11/386,825.

* cited by examiner

*Primary Examiner* — Philip Gabler
(74) *Attorney, Agent, or Firm* — Gowlings Lafleur & Henderson LLP; Mark Sprigings

(57) ABSTRACT

A portable fire fighter equipment station for use at a fire fighting scene is provided. The self-supporting frame comprising three support members pivotally connected to each other at one end, the self-supporting frame configurable into an in-use configuration with non-pivotally connected ends of the support members spaced apart to form a tripod and the self-supporting frame configurable into a transportation configuration with the three support members moved into close proximity. Each firefighter station is attached to one of the support members of the self-supporting frame and has a seating surface configurable into an in-use configuration to support a firefighter in a seated position, and a transportation configuration with the seating surface in close proximity to the self-supporting frame. A breathing apparatus holder is provided for securing an air bottle to the support member of the respective firefighter station.

20 Claims, 2 Drawing Sheets

PORTABLE SELF-SUPPORTING FIRE FIGHTING EQUIPMENT STATION

CROSS-REFERENCE TO RELATED APPLICATIONS

The application claims priority to U.S. patent application Ser. No. 11/386,825 filed Mar. 23, 2006, the contents of which are hereby incorporated by reference.

TECHNICAL FIELD

The present disclosure relates to the field of fire service equipment. In particular, to a portable self-supporting equipment station to be used by fire fighters while at a fire fighting scene.

BACKGROUND

A rehabilitation protocol is part of the standard operating procedures for many fire services. The rehabilitation protocol typically provides for firefighters involved in operations at an incident scene to be rotated through a rehabilitation area based on criteria such as, for example, a "two-cylinder rule" wherein a firefighter is required to attend the rehabilitation area after a second air cylinder has been exhausted. The reasons for attending the rehabilitation area include controlling the pace of physical activity (by providing rest periods), avoiding prolonged exposure to extreme temperatures, rehydration and medical evaluation.

The rehabilitation area is located outside of the fire zone and away from the exhaust fumes where protective clothing and equipment can be safely removed. Typically, the rehabilitation area includes supplies of water (or other liquids) and full air cylinders. The rehabilitation area can also provide shelter from precipitation, wind and sun. While in the rehabilitation area firefighters can be evaluated by paramedical staff and receive minor treatment if required.

Typical rehabilitation areas can take many forms depending on the size and severity of incident and on the scope and duration of operations. In one example, the rehabilitation area can be a tarp that is laid out on the ground or indoors to delineate the area in which the firefighters can rest, cool down, re-hydrate and replenish and in which they can lay-out their equipment and change their air cylinders. In some cases the rehabilitation area can be an ad hoc area in the vicinity of the firefighting equipment (i.e. vehicles) in which the firefighters congregate during rehabilitation. In these examples the rehabilitation area offers little in the way of amenities to facilitate the rehabilitation process with firefighters sitting on the ground or on vehicle bumpers and simply laying out their equipment on the ground or hanging it from whatever perch is available.

In a more elaborate, and less common, form the rehabilitation area can comprise a mobile rehabilitation vehicle specifically equipped for the rehabilitation function. Such vehicles are not commonly used as they are beyond the budgets of many fire services and even where they do exist, would typically only be deployed to incidents of a magnitude that warrants the logistic necessary for establishing a vehicle based rehabilitation area on scene.

What is needed is a relatively low cost, easy to deploy self-supporting fire fighting equipment station that provides amenities that facilitates the rehabilitation of firefighters attending an incident scene.

SUMMARY

In one aspect of the present disclosure there is provided a portable fire fighter equipment station comprising a self-supporting frame comprising three support members pivotally connected to each other at one end, the self-supporting frame configurable into an in-use configuration with non-pivotally connected ends of the support members spaced apart to form a tripod, and the self-supporting frame configurable into a transportation configuration with the three support members moved into close proximity. A plurality of firefighter stations each attached to one of the support members of the self-supporting frame. Each firefighter station comprising a seating surface configurable into an in-use configuration, with the seating surface arranged for supporting a firefighter in a seated position, and a transportation configuration with the seating surface in close proximity to the self-supporting frame. A breathing apparatus holder for securing an air bottle to the support member of the respective firefighter station, the breathing apparatus holder for securing the air bottle above the seating surface proximate to the self-supporting frame end having the pivotally connected members and at least one protective equipment holder positioned above the seating surface proximate the self-supporting frame end having the pivotally connected members. A pliable surface is suspended between each of the support members providing a planar surface when in the in-use configuration, each of the corners of the pliable surface are connected to respective support members at points between the pivotally connected ends and the non-pivotally connected ends of each support member forming the tripod, the pliable surface having an axis which is in a different plane than each axis of the support members wherein the pliable surface provides a surface for holding lightweight pieces of protective equipment.

Other aspects and features of the present disclosure will become apparent to those ordinarily skilled in the art or science to which it pertains upon review of the following description of specific embodiments of the disclosure in conjunction with the accompanying figures.

BRIEF DESCRIPTION OF DRAWINGS

The present disclosure will be described in conjunction with drawings in which.

DETAILED DESCRIPTION

Figure 1:
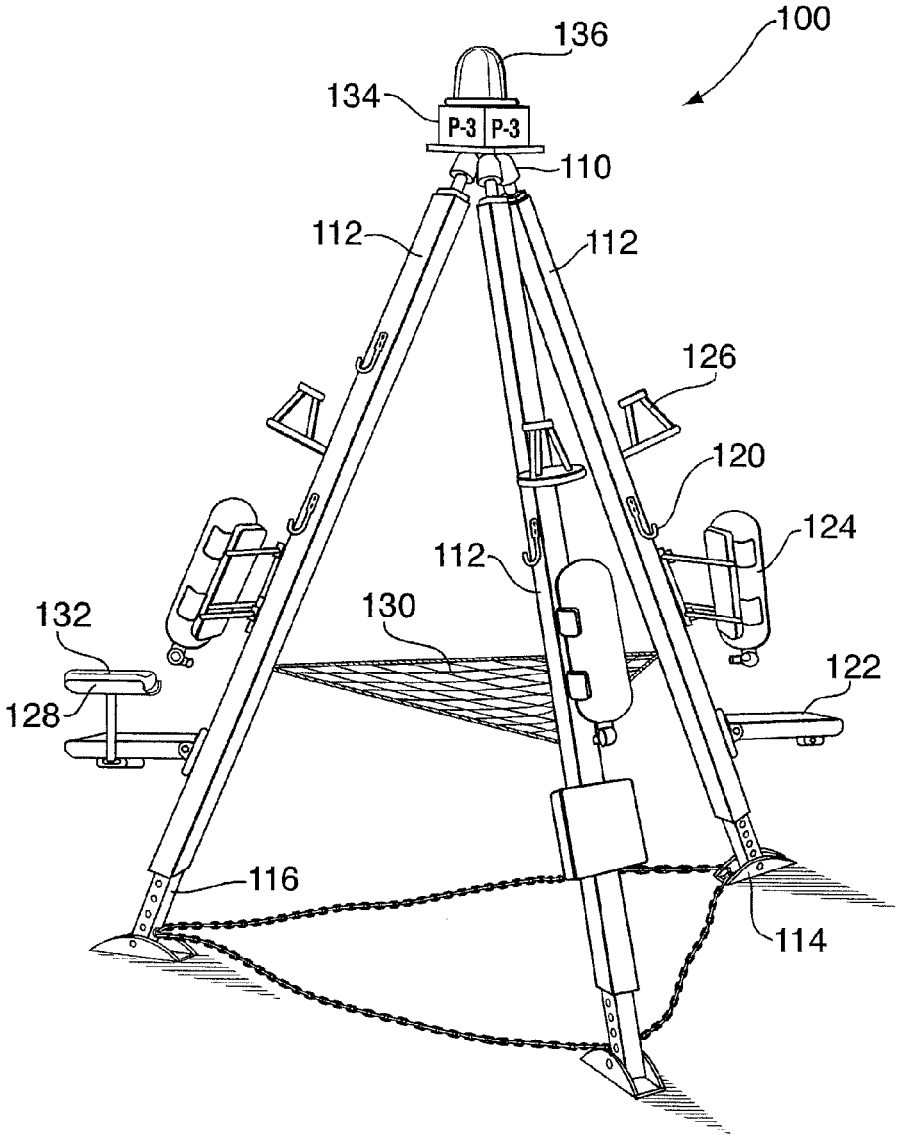
FIG. 1 is a perspective view of an exemplary embodiment of a self-supporting fire fighting equipment station as it appears in use.

FIG. 1 is a perspective view of an exemplary embodiment of a portable self-supporting fire fighting equipment station 100 as it appears in use. The portable self-supporting fire fighting equipment station 100 comprises a self-supporting frame 110 and three firefighter stations 120 attached to the frame 110. Each firefighter station 120 comprises a seating surface 122, a breathing apparatus holder 124 and a protective equipment holder 126.

The frame 110 comprises three support members 112 pivotally connected at one end such at they can form a tripod. The other ends of the support members 112 can be connected to each other using a chain, cable or similar mechanism to limit the spreading apart of support members 112 where they form the base of the tripod. Each of the firefighter stations 120 is attached to one of three support members 112. The support members 112 can, for example, be formed from tubular stock having a round, square, rectangular, triangular or other cross-sectional profile. Each support member can optionally be equipped with a leveling mechanism 114 such as, for example, a telescopic foot assembly for facilitating leveling of the self-supporting fire fighting equipment station 100 when it is deployed on an even surface. In an alternative embodiment the leveling mechanism 114 can comprise a screw and nut assembly or other similar mechanisms for changing the effective length of the support member. Each support member can optionally comprise a telescopic section 116 for facilitating transport of the self-supporting fire fighting equipment station 100 by allowing the support members 112 to be shortened when the system is configured for transportation. In a further alternate embodiment, the leveling mechanism 114 and the telescopic section 116 can be combined to facilitate both leveling and transportation of the self-supporting fire fighting equipment station 100.

The embodiment of the self-supporting fire fighting equipment station 100 illustrated in FIG. 1 is adapted to concurrent use by a three-person fire crew. In an alternative embodiment (not illustrated), the frame 110 can comprise three or more support members 112 that can form a self-supporting structure having correspondingly three or more firefighter stations 120, each attached to a support member 112, that can accommodate larger fire crews.

The seating surface 122 provides a place for the firefighter to sit while resting, cooling down, re-hydrating and replenishing. The seating surface 122 is preferably arranged in the firefighter station to provide easy access by the firefighter and also to allow a para-medical staff member to easily interact with the seated firefighter during a medical evaluation. The seating surface 122 can be foldable or storable in order to facilitate transportation and storage of the self-supporting fire fighting equipment station 100. Optionally the seating surface 122 can include a pair of armrests 128 positioned on opposite sides of the seating surface 122. The armrests 128 can be foldable or storable in order to facilitate transportation and storage of the self-supporting fire fighting equipment station 100.

The breathing apparatus holder 124 provides for the breathing apparatus to be held in place so that if is easily accessible by the firefighter or other support personnel while also not obstructing access to the firefighter station or presenting a trip hazard to personnel moving in the vicinity of the rehabilitation area. The breathing apparatus holder 124 can be adapted to holding commonly used breathing apparatus such as, for example, air bottles and self-contained breathing apparatus (SCBA). The breathing apparatus holder 124 can be used to hold either a spent breathing apparatus or a fresh replacement breathing apparatus. The breathing apparatus holder 124 can be foldable or storable in order to facilitate transportation and storage of the self-supporting fire fighting equipment station 100.

The protective equipment holder 126 provides for supporting the firefighter's protective equipment off of the ground and keeping them organized. The protective equipment can include, for example, a jacket, a helmet, gloves, a flashlight and tools. The protective equipment holder 126 can keep these items organized so they are easily located, keeps them off of the ground so that they do not present a trip hazard, so that they can more effectively dried if required, reduces the potential for damage to the equipment and also mitigates potential contamination and cross-contamination of the protective equipment. The protective equipment holder 126 can comprises, for example, a plurality of hooks or similar holding mechanisms that can be adapted to holding a range of protective equipment of various sizes, shapes and weights. The protective equipment holder 126 can optionally comprise a mesh, fabric or similar pliable surface 130, suspended between the support members 112, that is adapted to holding lightweight pieces of protective equipment such as gloves and balaclavas. The protective equipment holder 126 can be foldable or storable in order to facilitate transportation and storage of the self-supporting fire fighting equipment station 100.

In an alternative embodiment the firefighter stations 120 can each be optional equipped with a core-cooling device 132 for promoting rapid lowering of a firefighters core body temperature. The core-cooling device 132 can, for example, comprise a mechanism, such as a tray, incorporated into armrests 128 for holding a cooling source, such as an ice pack or a cold water bladder, for ease of contact with the each of the forearms of a firefighter seated on the seating surface 122.

The self-supporting fire fighting equipment station 100 can optionally include a crew identification sign 134 connected to the frame 110 to assist the fire crew and others in locating the rehabilitation area and in promoting general organization of the incident scene. The self-supporting fire fighting equipment station can also be optionally equipped with a lighting fixture 136 connected to the frame 110. The lighting fixture 136 can be used to assist in locating the rehabilitation area or to provide ambient lighting in the rehabilitation area.

Figure 2:
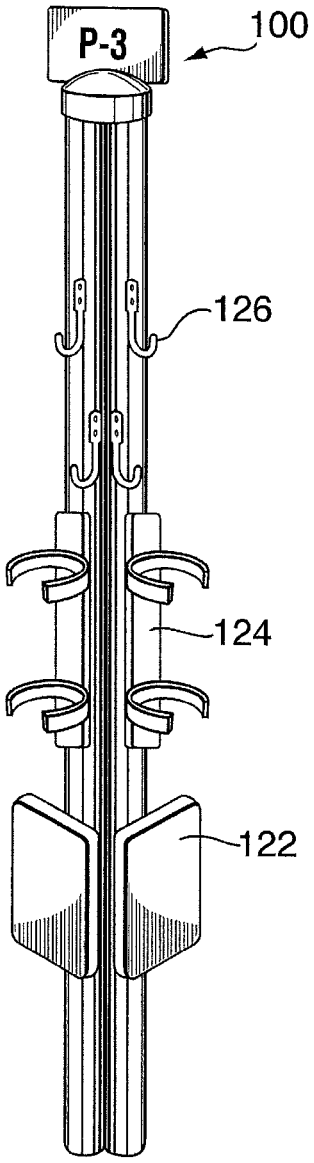
FIG. 2 is a perspective view of an exemplary embodiment of a self-supporting fire fighting equipment station as it appears when configured for transportation.
Figure 3:
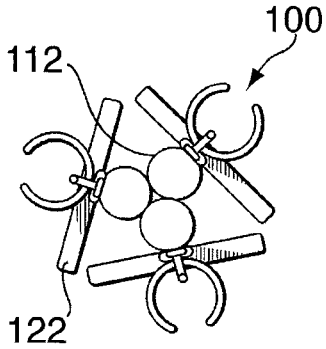
FIG. 3 is a top view of an exemplary embodiment of a self-supporting fire fighting equipment station as it appears when configured for transportation.

FIGS. 2 and 3 are a perspective view and a top view, respectively, of an exemplary embodiment of a self-supporting fire fighting equipment station 100 as it appears when configured for transportation. The self-supporting fire fighting equipment station 100 can be configured for transportation by collapsing the tripod and bringing the support members 112 into close proximity where they can be secured. Support members 112 equipped with leveling mechanisms 114 or telescopic sections 116 can be shortened. Transportation can be further facilitated by folding or storing any of seating surfaces 122, armrests 128, breathing apparatus holders 124 and protective equipment holders 126 that can be so configured. When configured for transportation the self-supporting fire fighting equipment station 100 can be stored on a fire engine or similar vehicle for transportation to and from the incident scene.

The self-supporting fire fighting equipment station 100 as described above provides a relatively low cost, easy to deploy system that provides amenities that facilitates the rehabilitation of firefighters attending an incident scene. The self-supporting fire fighting equipment station 100 can also be used as a suit-up station, for example, in a staging area at a hazardous material incident scene.

It will be apparent to one skilled in the art that numerous modifications and departures from the specific embodiments described herein may be made without departing from the spirit and scope of the present disclosure.

The invention claimed is:

1. A portable fire fighter equipment station comprising:

a self-supporting frame comprising three support members pivotally connected to each other at one end, the self-supporting frame configurable into an in-use configuration with non-pivotally connected ends of the support members spaced apart to form a tripod, and the self-supporting frame configurable into a transportation configuration with the three support members moved into close proximity; and a plurality of firefighter stations each attached to one of the support members of the self-supporting frame, each firefighter station comprising:

a seating surface configurable into an in-use configuration, with the seating surface arranged for supporting a firefighter in a seated position, and a transportation configuration with the seating surface in close proximity to the self-supporting frame;

a breathing apparatus holder for securing an air bottle to the support member of the respective firefighter station, the breathing apparatus holder for securing the air bottle above the seating surface proximate to the self-supporting frame end having the pivotally connected members; and at least one protective equipment holder positioned above the seating surface proximate the self-supporting frame end having the pivotally connected members; and a pliable surface is suspended between each of the support members providing a planar surface when in the in-use configuration, each of the corners of the pliable surface are connected to respective support members at points between the pivotally connected ends and the non-pivotally connected ends of each support member forming the tripod, the pliable surface having an axis which is in a different plane than each axis of the support members wherein the pliable surface provides a surface for holding lightweight pieces of protective equipment.

2. The fire fighter equipment station of claim 1, each support member further comprising a levelling mechanism that can change the effective length of the support member.

3. The fire fighter equipment station of claim 2, each support member further comprising a telescopic section that provides for the support members to be shortened when the self-supporting frame is configured into the transportation configuration.

4. The fire fighter equipment station of claim 3, wherein each of the breathing apparatus holders is configurable into an in-use configuration and a transportation configuration with the breathing apparatus holders in close proximity to the self-supporting frame.

5. The fire fighter equipment station of claim 4 wherein the breathing apparatus holder is adapted to hold air bottles and self-contained breathing apparatus (SCBA).

6. The fire fighter equipment station of claim 5, wherein the at least one protective equipment holders is configurable into an in-use configuration and a transportation configuration with the protective equipment holders in close proximity to the self-supporting frame.

7. The fire fighting equipment station of claim 1, wherein each seating surface is foldable to a position parallel a surface supporting the non-pivotally connected ends of the support members when spaced apart to form the tripod, and each seating position foldable to a position parallel to an axis of the support member in the transportation configuration.

8. The fire fighter equipment station of claim 7, each seating surface further comprising a pair of armrests positioned on opposite sides of the seating surface.

9. The fire fighter equipment station of claim 8, wherein the pair of armrests are foldable relative to the seating surface.

10. The fire fighter equipment station of claim 9, wherein the breathing apparatus holders is configurable into an in-use configuration and a transportation configuration with the breathing apparatus holders in close proximity to the self-supporting frame.

11. The fire fighter equipment station of claim 9, wherein the at least one protective equipment holders is configurable into an in-use configuration and a transportation configuration with the protective equipment holders in close proximity to the self-supporting frame.

12. The fire fighter equipment station of claim 9, each firefighter station further comprising a core-cooling device.

13. The fire fighter equipment station of claim 12, the core-cooling device further comprising a pair of cooling sources and a mechanism in each of a pair of armrests for holding one of the pair of cooling sources; wherein a firefighter seated on the seating surface can put his forearms in contact with the cooling sources.

14. The fire fighter equipment station of claim 13 wherein each one of the pair of cooling sources is an ice pack or a cold water bladder.

15. The fire fighter equipment station of claim 1 wherein each of the at least one protective equipment holders comprises a coat hook.

16. The fire fighter equipment station of claim 15 wherein each of the at least one protective equipment holders further comprises helmet support.

17. The fire fighter equipment station of claim 1, the at least one protective equipment holder further comprising a plurality of hooks adapted to holding protective equipment of various sizes, shapes and weights.

18. The fire fighter equipment station of claim 17, further comprising a crew identification sign connected to the self-supporting frame.

19. The fire fighter equipment station of claim 18, further comprising a lighting fixture connected to the self-supporting frame.

20. The fire fighter equipment station of claim 1 wherein the support member are formed from tubular stock having a round, square, rectangular, or triangular cross-sectional profile.

* * * * *